US009074495B2

(12) United States Patent
Flierl et al.

(10) Patent No.: US 9,074,495 B2
(45) Date of Patent: Jul. 7, 2015

(54) MECHANICALLY CONTROLLABLE VALVE-TRAIN ASSEMBLY

(75) Inventors: Rudolf Flierl, Hirschau (DE); Manfred Kloft, Koenigslutter (DE); Paul Gnegel, Lehre (DE); Karsten Grimm, Aachen (DE); Martin Nowak, Leverkusen (DE)

(73) Assignee: KOLBENSCHMIDT PIERBURG INNOVATIONS GMBH, Neckarsulm (DE)

( * ) Notice: Subject to any disclaimer, the term of this patent is extended or adjusted under 35 U.S.C. 154(b) by 0 days.

(21) Appl. No.: 13/980,575

(22) PCT Filed: Jan. 13, 2012

(86) PCT No.: PCT/EP2012/050473

§ 371 (c)(1),
(2), (4) Date: Jul. 19, 2013

(87) PCT Pub. No.: WO2012/100993

PCT Pub. Date: Aug. 2, 2012

(65) Prior Publication Data

US 2013/0306010 A1 Nov. 21, 2013

(30) Foreign Application Priority Data

Jan. 25, 2011 (DE) ..... 10 2011 009 417

(51) Int. Cl.
*F01L 1/02* (2006.01)
*F01L 1/34* (2006.01)
(Continued)

(52) U.S. Cl.
CPC .... *F01L 1/34* (2013.01); *F01L 1/04* (2013.01); *F01L 1/46* (2013.01); *F01L 13/0021* (2013.01); *F01L 13/0026* (2013.01);
(Continued)

(58) Field of Classification Search
CPC ..... F01L 1/04; F01L 1/34; F01L 1/46; F01L 13/0021; F01L 13/0026
USPC ..... 123/90.15, 90.17, 90.16, 90.27, 90.31, 123/90.39, 90.44
See application file for complete search history.

(56) References Cited

U.S. PATENT DOCUMENTS 4,441,243 A 4/1984 Stojek
4,723,517 A 2/1988 Frost
(Continued)

FOREIGN PATENT DOCUMENTS

CN 1802490 A 7/2006
DE 31 26 280 C1 1/1983
(Continued)

*Primary Examiner* — Ching Chang
(74) *Attorney, Agent, or Firm* — Norman B. Thot

(57) ABSTRACT

A mechanically controllable valve-train assembly includes a plurality of gas exchange valves, at least two cylinders assigned to each of the gas exchange valves, and valve-lift adjusting devices which each comprise a rotatable eccentric shaft. The eccentric shaft comprises at least one cam element and circumferential control surfaces which comprise at least one eccentric member. The eccentric shaft is driven by a drive device to set various valve-lift positions. A transmission assembly assigned to each of the gas exchange valves is mounted in a cylinder head via a bearing device so as to be movable and is operatively connected to one of the valve-lift adjusting devices and to a camshaft. The at least one cam element is operatively connected to a spring-loaded tappet element and is arranged outside the circumferential control surfaces and at a level of a zero-lift position of the circumferential control surfaces.

11 Claims, 3 Drawing Sheets

(51) Int. Cl.

| | |
|---|---|
| ***F01L 1/46*** | (2006.01) |
| ***F01L 13/00*** | (2006.01) |
| *F01L 1/04* | (2006.01) |
| *F01L 1/047* | (2006.01) |

(52) U.S. Cl.
CPC . *F01L 2001/0478* (2013.01); *F01L 2013/0068* (2013.01); *F01L 2800/12* (2013.01)

(56) References Cited

U.S. PATENT DOCUMENTS

| | | | | |
|---|---|---|---|---|
| 5,873,335 | A | 2/1999 | Wright et al. | |
| 7,430,997 | B2 | 10/2008 | Muraji et al. | |
| 8,109,246 | B2 * | 2/2012 | Gallon et al. | 123/90.48 |
| 2004/0261738 | A1 | 12/2004 | Machida et al. | |
| 2007/0074687 | A1 | 4/2007 | Bosl-Flierl et al. | |
| 2007/0199530 | A1 | 8/2007 | Tsutsumi et al. | |
| 2008/0017151 | A1 | 1/2008 | Kusaka et al. | |
| 2008/0078341 | A1 * | 4/2008 | Akasaka et al. | 123/90.11 |
| 2010/0059005 | A1 * | 3/2010 | Stone et al. | 123/90.16 |
| 2010/0224155 | A1 | 9/2010 | Gallon et al. | |
| 2011/0155083 | A1 * | 6/2011 | Sato et al. | 123/54.4 |
| 2013/0199472 | A1 * | 8/2013 | Flierl | 123/90.15 |
| 2014/0202406 | A1 * | 7/2014 | Nakamura | 123/90.15 |

FOREIGN PATENT DOCUMENTS

| | | | |
|---|---|---|---|
| DE | 196 29 881 | A1 | 1/1998 |
| DE | 10 2004 003 327 | A1 | 9/2005 |
| EP | 1826367 | A1 * | 8/2007 |
| JP | 2007-224777 | A | 9/2007 |
| JP | 2008-231964 | A | 10/2008 |

* cited by examiner

MECHANICALLY CONTROLLABLE VALVE-TRAIN ASSEMBLY

CROSS REFERENCE TO PRIOR APPLICATIONS

This application is a U.S. National Phase application under 35 U.S.C. §371 of International Application No. PCT/EP2012/050473, filed on Jan. 13, 2012 and which claims benefit to German Patent Application No. 10 2011 009 417.2, filed on Jan. 25, 2011. The International Application was published in German on Aug. 2, 2012 as WO 2012/100993 A1 under PCT Article 21(2).

FIELD

The present invention relates to a mechanically controllable valve-train assembly comprising a plurality of serially arranged gas exchange valves having assigned thereto at least two serially arranged cylinders, wherein at least one gas exchange valve has a transmission assembly assigned thereto, each transmission assembly is mounted movably in the cylinder head with the aid of bearing means, and each transmission assembly is operatively connected to a respective valve-lift adjusting device and a camshaft, and each valve-lift adjusting device comprises a rotatable eccentric shaft having circumferential control surfaces with at least one eccentric member, which eccentric shaft can be driven by a drive means in such a way that various valve-lift positions can be set.

BACKGROUND

A mechanically controllable valve-train assembly of the above type is described in DE 10 2004 003 327 A1. This patent application describes an assembly which comprises an eccentric shaft having circumferential control surfaces with eccentric members so as to allow for lift adjustments of gas exchange valves between a zero lift and a maximum lift. This embodiment, apart from offering high variability, is also advantageous in regard to the manufacture and assembly processes. A disadvantage of this embodiment is that the transmission assembly and particularly an intermediate lever of the transmission assembly are supported during their movement on the eccentric shaft, thereby causing a force to act on the eccentric shaft at an off-center position. An average moment of rotation is consequently generated which is not constant along the circumference of the eccentric shaft and which has to be compensated for by the drive means. Dependent on the rotary angle of the eccentric shaft comprising an eccentric member, two positions exist where this moment is zero: the position with the largest lift adjustment and the position with the smallest lift adjustment, while only the position with the smallest lift adjustment will provide a stable equilibrium. This has the consequence, however, that a defect of the drive means will cause the eccentric shaft to be transferred into the position of the stable equilibrium, which, in a construction where the smallest lift adjustment describes a zero lift, will result in a failure of the overall internal combustion machine.

SUMMARY

An aspect of the present invention is to provide a valve-train assembly which avoids the above-mentioned disadvantage and which offers the option of providing a fail-safe function for cases when a defect occurs in the drive means of the eccentric shaft.

In an embodiment, the present invention provides a mechanically controllable valve-train assembly which includes a plurality of serially arranged gas exchange valves. At least two serially arranged cylinders are assigned to each of the gas exchange valves. Valve-lift adjusting devices, each of which comprise an eccentric shaft configured to be rotatable. The eccentric shaft comprises at least one cam element and circumferential control surfaces which comprise at least one eccentric member. The eccentric shaft is configured to be driven by a drive device so that various valve-lift positions can be set. A transmission assembly is assigned to each of the gas exchange valves. Each transmission assembly is mounted in a cylinder head via a bearing device so as to be movable. Each transmission assembly is operatively connected to one of the valve-lift adjusting devices and to a camshaft. The at least one cam element of the eccentric shaft is operatively connected to a spring-loaded tappet element and is arranged outside the circumferential control surfaces when viewed in a longitudinal direction of the eccentric shaft, and, when viewed in a circumferential direction of the eccentric shaft, is arranged at a level of a zero-lift position of the circumferential control surfaces. It is thereby provided that, in case of a defect of the drive means, the eccentric shaft will assume a position effecting a specific lift adjustment of the inlet valves.

BRIEF DESCRIPTION OF THE DRAWINGS

The present invention is described in greater detail below on the basis of embodiments and of the drawings in which.

DETAILED DESCRIPTION

In an embodiment of the present invention, the tappet element acts on the circumferential surface of the eccentric shaft via a roller. A friction-free embodiment is obtained, however, if the tappet element is caused to act on the circumferential surface of the eccentric shaft via a rolling bearing. It is to be expressly noted once again that this is merely one embodiment. It can also be provided that the tappet element acts on the circumferential surface of the eccentric shaft via a smooth contour. It is further advantageous if the tappet element comprises a cage in which a spring member, for example, a coil spring, is supported. In this arrangement, the cam element can be formed on a cam-holding projection portion which is fastened to one of the two ends of the eccentric shaft by form- and/or force-locked engagement.

In an embodiment of the present invention where all possible contours of the eccentric members are located within a circle formed by the outer diameters of an eccentric shaft bearing and where the eccentric shaft comprises corresponding bearing surfaces, the eccentric shaft can be formed as a so-called pass-through eccentric shaft, which is of benefit for the manufacture and assembly processes. It can be advantageous if the drive means is arranged to drive the eccentric shaft via a gear member, wherein the gear member comprises a pass-through opening for the eccentric shaft and is connected to the bearing surface by form- and/or force-locked engagement. In an embodiment of the present invention, the gear member can comprise a projection portion on which the cam element is formed. In this case, the cylinder head can be provided with abutment faces internally thereof which are abutted by the transmission member on both sides in the axial direction.

In an embodiment of the present invention, each transmission assembly comprises at least one pivot lever and at least one tilt lever, wherein the pivot lever engages the gas exchange valve with a work curve and said tilt lever is operatively connected to the valve-lift adjusting device and the camshaft and engages the pivot lever via a work contour.

The present invention will be explained in greater detail hereunder with reference to the drawings.

Figure 1:
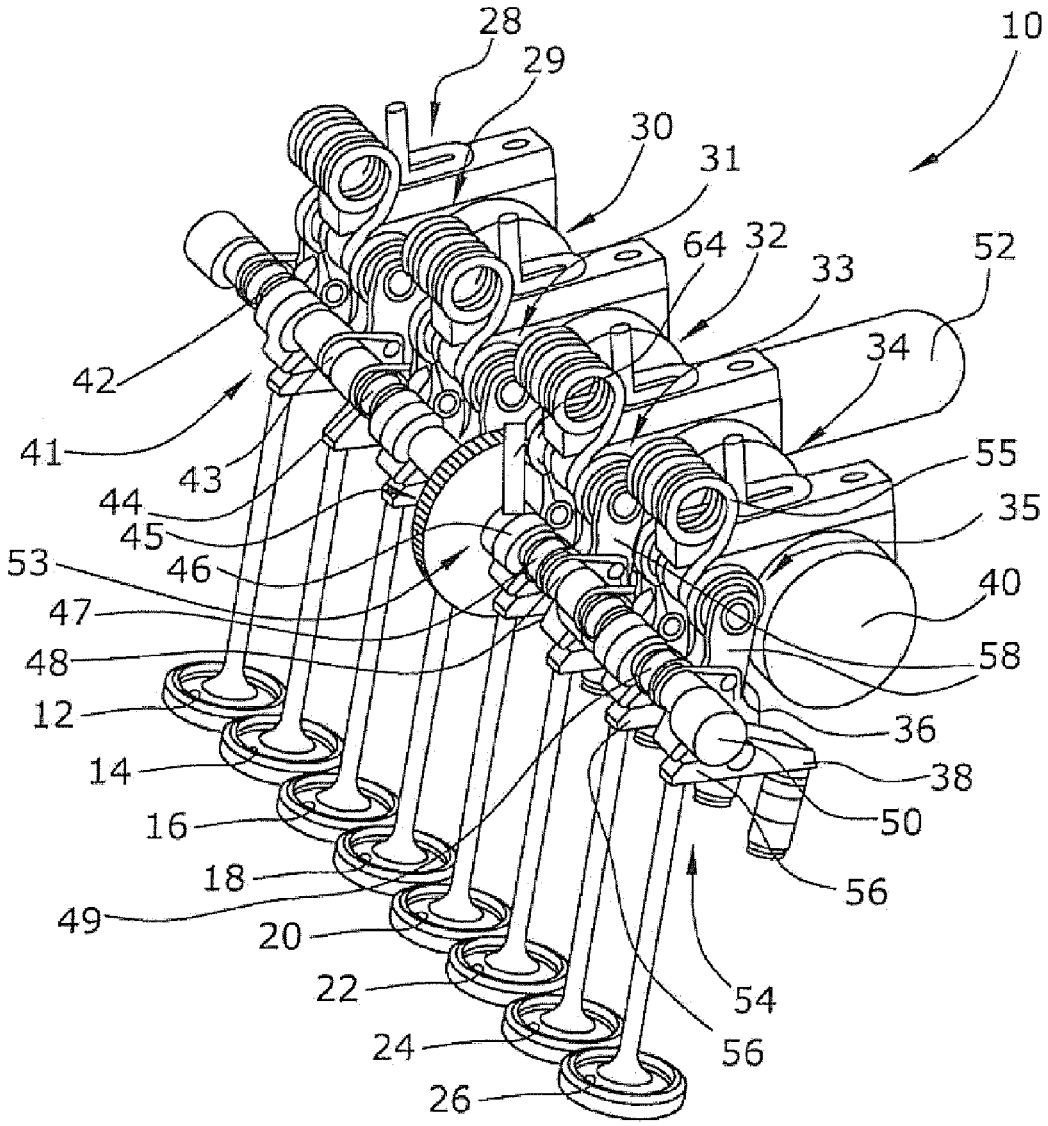
FIG. 1 is a perspective view of an embodiment of a valve-train assembly according to the present invention.

FIG. 1 illustrates an embodiment of a valve-train assembly 10 according to the present invention comprising a plurality of serially arranged gas exchange valves (inlet valves) 12, 14, 16, 18, 20, 22, 24 and 26. In the present case, two respective gas exchange valves are assigned to a cylinder of the internal combustion engine. The mechanically controllable valve-train assembly 10 comprises, in the present case, four transmission assemblies 28, 29; 30, 31; 32, 33 and 34, 35 have assigned to them two respective gas exchange valves 12, 14; 16, 18; 20, 22; 24, 26. The transmission assemblies 28, 29; 30, 31; 32, 33 and 34, 35 are supported in the cylinder head in a known manner with the aid of bearing means. In FIG. 1, the bearing means 36, 38 are shown merely by way of example of the support of a pivot lever 56 of the transmission assembly 35. Apart from the above, the transmission assemblies 28, 29; 30, 31; 32, 33 and 34, 35 are operatively connected to a camshaft 40 in a known manner. Each transmission assembly 28, 29; 30, 31; 32, 33 and 34, 35 is further controllable by circumferential control surfaces 42, 43; 44, 45 (not visible here); 46, 47 and 48, 49 together with corresponding adjustment members of a valve-lift adjusting device 41 in a manner allowing for the setting of a smaller or larger valve lift of the gas exchange valves 12, 14; 16, 18; 20, 22; 24, 26, which is effected by eccentric members provided on an eccentric shaft 50. In the present case, the eccentric shaft 50 is driven by a drive means 52 via a transmission member 53 formed as a gear 53. In this embodiment, the eccentric shaft 50 is formed as a pass-through eccentric shaft wherein all possible contours of the eccentric members are arranged within a circle defined by the outer diameters of an eccentric-shaft bearing. As a drive means 52, use can be made of a rotary drive designed for forward and rearward rotation. The eccentric shaft 50 can thus be driven in a manner that, in dependence on the current position, the valve lift corresponding to the next operational state can be selected quickly and precisely by use of the corresponding eccentric members, the latter not being shown. Rotational angles >360° can also be realized in this manner.

In the shown embodiment, a mechanically controllable valve drive 54 comprises the transmission assembly 35 and the gas exchange valve 26. The transmission assembly 35 herein consists of the pivot lever 56 and a tilt lever 58, wherein the pivot lever 56 engages the gas exchange valve 26 with a work curve and the tilt lever 58 is operatively connected to the valve-lift adjusting device 41 and the camshaft 40. In this arrangement, the circumferential control surface 48, by way of an adjustment member of valve-lift adjusting device 41, engages an engagement member (e.g., a roller), not shown, of pivot lever 58 against a bias force of a spring 55. Tilt lever 58 engages pivot lever 56 with a work contour, the latter not being shown. On the opposite side, guide rollers are arranged for guiding the pivot lever 56 in a sliding block. Said guide rollers are in turn supported on a shaft connecting two adjacent tilt levers to each other, wherein, between the guide rollers, there is further arranged a roller on the shaft which in turn is operatively connected to the camshaft. A cam of the camshaft is thus in an operative connection with two transmission assemblies. With regard to the function and the principle of operation of such a transmission assembly, explicit reference is made to DE 101 40 635 A1. It should be evident that, in the shown embodiment, the respective tilt levers can exert an eccentrically engaging force on the eccentric shaft 50, said force being effective to generate a moment of rotation which, in case of a failure of the drive means 52, will rotate the eccentric shaft 50 into a stable position causing a zero lift of the gas exchange valves and consequently resulting in a failure of the internal combustion engine. In order to prevent such an occurrence and to safeguard a fail-safe position which will provide a specific lift adjustment, the present invention provides that the eccentric shaft 50 comprises at least one cam element 62 (see FIG. 2) which, when viewed in the longitudinal direction of eccentric shaft 50, is arranged outside the circumferential control surfaces 42, 43; 44, 45; 46, 47; 48, 49 and which is operatively connected to a spring-loaded tappet element 64, wherein the cam element 62, when viewed in the circumferential direction, is arranged at the level of the zero-lift settings of the circumferential control surfaces 42, 43; 44, 45; 46, 47; 48, 49. In the shown embodiment, the tappet element 64 is spring-loaded by a coil spring 66 supported in a cage 68. This arrangement generates a moment of rotation to counteract the moments of rotation of the tilt levers, resulting in a stable equilibrium of eccentric shaft 50 wherein the valve lift is unequal to zero (in this regard, see FIG. 3). It should be understood, however, that the cam element 62 can also be arranged on the eccentric shaft 50 via a single cam-holding projection portion. It can be disadvantageous if the contour of cam element 62 is also located within the circle defined by the outer diameters of the eccentric shaft bearing. The production step for mounting the cam element 62 can thereby be omitted.

Figure 2:
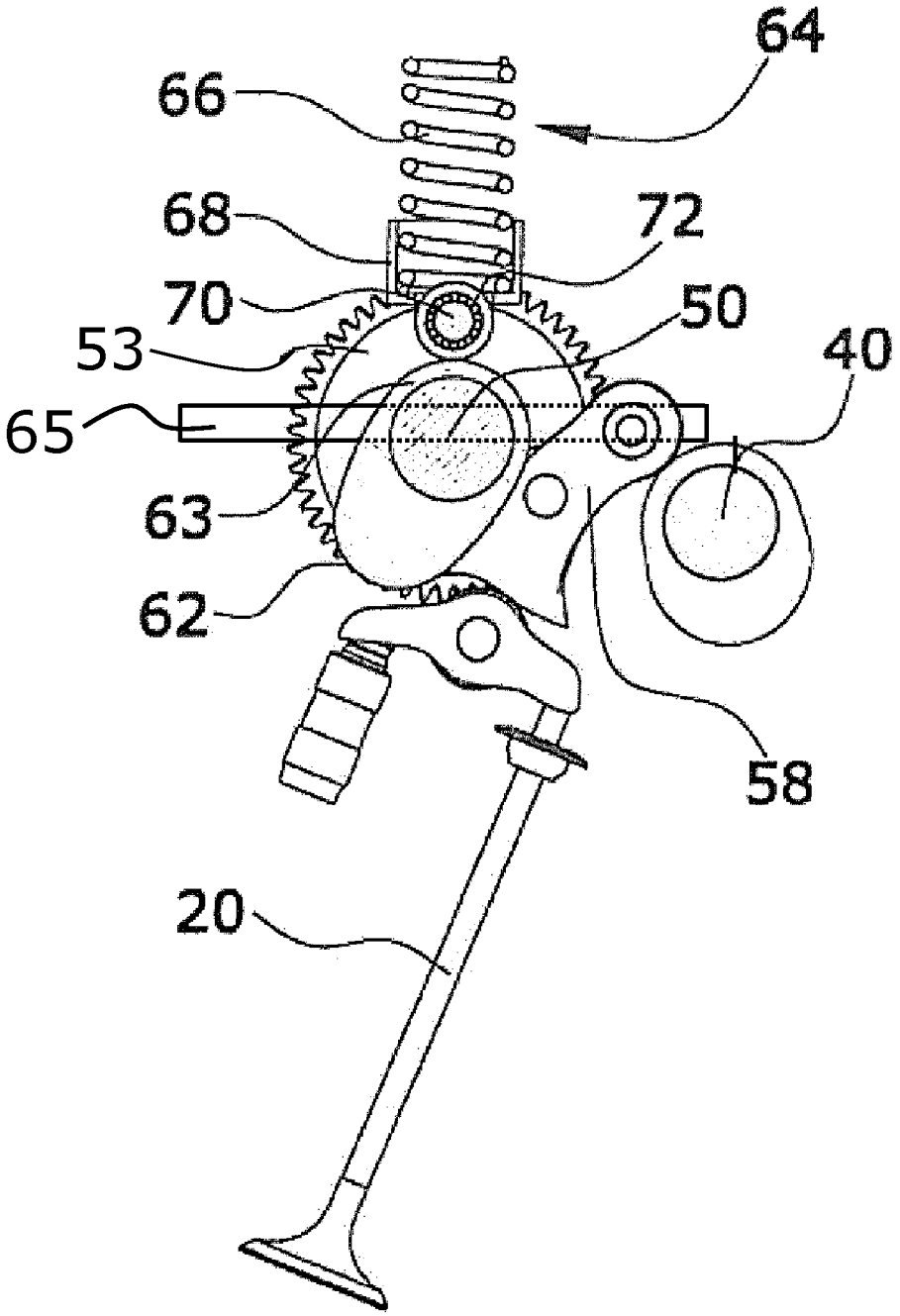
FIG. 2 is a cross-sectional view of the eccentric shaft of FIG. 1 as supported in the cylinder head, at the level of the cam element.

FIG. 2 is a cross-sectional view of the eccentric shaft 50 of FIG. 1 supported in the cylinder head at the level of cam element 62. In the shown embodiment, cam element 62 is formed on a projection portion 63 of gear member 53. Gear member 53 is releasably connected to eccentric shaft 50 via a screw connection, not shown. Tappet element 64 substantially comprises a coil spring 66 which is held in a known manner on a projection portion in the cylinder head and is supported in cage 68 in such a manner that, via a pin 70 connected to cage 68 and a rolling bearing 72 arranged thereon, it is operatively connected to the circumferential surface of eccentric shaft 50. It can of course also be provided that the tappet element 64 will act on the circumferential surface of eccentric shaft 50 via a smooth contour or, for example, a roller. In case of failure of the drive means 52, the cooperation of cam element 62 and tappet element 64 will result in the setting of a stable equilibrium position of eccentric shaft 50 wherein, in any case, there is provided a non-zero lift of the inlet valves upon actuation by the camshaft 40. In the present case, cam element 62 is formed on projection portion 63. It should be evident that the cam element 62 can also be formed on a single cam-holding projection portion. In this manner, there could also be selected a position on one of the ends of eccentric shaft 50. It can also be provided that the cam element 62 is formed integrally with the eccentric shaft 50 and that the contour of cam element 62 is located within the circle defined by the outer diameters of an eccentric shaft bearing. The cylinder head is provided with abutment faces (only one of which is shown in FIG. 2) internally thereof which are abutted by the transmission member on both sides in the axial direction.

Figure 3:
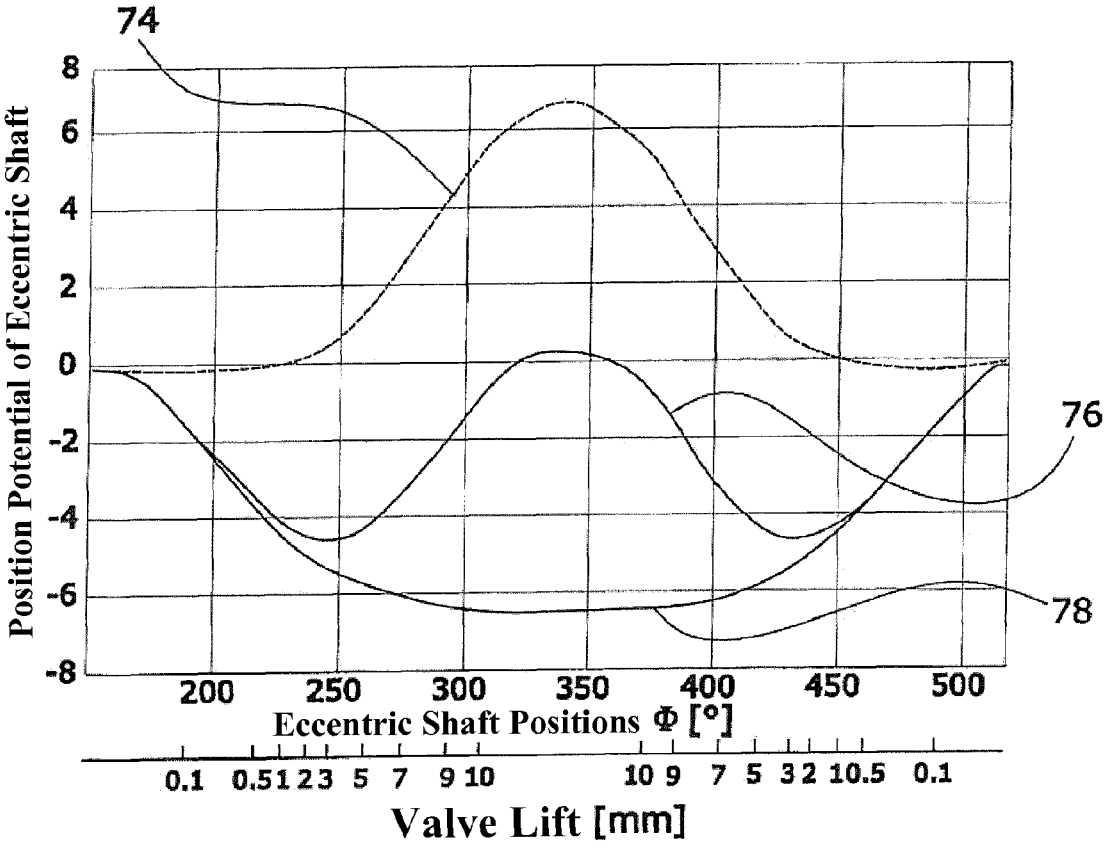
FIG. 3 is a schematic representation of the various positional potentials of the eccentric shaft as caused by the effective moments.

FIG. 3 shows, by way of example, a schematic representation of the various position potentials of the eccentric shaft 50 due to the effective moments at various positions of the eccentric shaft. The position potential herein is defined as follows: $U(\Phi)=\int M\, d\Phi(J)$. The curve 74 shows the position potential of eccentric shaft 50 due to the moment of rotation applied by the tilt levers. The stable equilibrium position (characterized by the lowest position potential; here, in the curve 74, is 0) will be assumed at a valve lift 0, which entails the problems discussed above. The curve 78 shows the position potential due to the moment of rotation of tappet element 64 in cooperation with cam element 62. The curve 76, in turn, shows the position potential of eccentric shaft 50 wherein two stable equilibrium positions (here, position potential=−4) allow for a valve stroke of maximally about 3 mm. Depending on the orientation of the eccentric shaft at which, in operation, the fail-safe position has to be assumed, one of the two fail-safe positions will be taken.

The present invention is not limited to embodiments described herein; reference should be had to the appended claims.

What is claimed is:

1. A mechanically controllable valve-train assembly comprising:

a plurality of serially arranged gas exchange valves;

at least two serially arranged cylinders each of which have at least two of the plurality of gas exchange valves assigned thereto;

valve-lift adjusting devices, each of the valve-lift adjusting devices comprising an eccentric shaft configured to be rotatable, the eccentric shaft comprising at least one cam element and circumferential control surfaces which comprise at least one eccentric member, the eccentric shaft being configured to be driven by a drive device so that various valve-lift positions can be set;

a camshaft;

a cylinder head;

a bearing device;

a transmission assembly assigned to each of the plurality of gas exchange valves, each transmission assembly being mounted in the cylinder head via the bearing device so as to be movable, and each transmission assembly being operatively connected to one of the valve-lift adjusting devices and to the camshaft;

a spring-loaded tappet element; and a roller bearing;

wherein, the at least one cam element of the eccentric shaft is operatively connected to the spring-loaded tappet element and is arranged outside the circumferential control surfaces when viewed in a longitudinal direction of the eccentric shaft, and, when viewed in a circumferential direction of the eccentric shaft, is arranged at a level of a zero-lift position of the circumferential control surfaces, and the spring-loaded tappet element is configured to directly act on the circumferential control surfaces of the eccentric shaft via the rolling bearing.

2. The mechanically controllable valve-train assembly as recited in claim 1, further comprising a roller, wherein the spring-loaded tappet element is configured to operatively act on the circumferential control surfaces of the eccentric shaft via the roller.

3. The mechanically controllable valve-train assembly as recited in claim 1, further comprising a cam-holding projection portion fastened to an end of the eccentric shaft by at least one of a form-locked engagement and a force-locked engagement, wherein the at least one cam element is formed on the cam-holding projection portion.

4. The mechanically controllable valve-train assembly as recited in claim 1, further comprising a spring member, wherein the spring-loaded tappet element comprises a cage which is configured to support the spring member therein.

5. The mechanically controllable valve-train assembly as recited in claim 4, wherein the spring member is a coil spring.

6. The mechanically controllable valve-train assembly as recited in claim 1, wherein a contour of the cam element is also located within the circle formed by the outer diameters of the eccentric shaft bearing.

7. The mechanically controllable valve-train assembly as recited in claim 1, futher comprising a gear member which comprises a pass-through opening for the eccentric shaft, the gear member being connected to the bearing surface by at least one of a form-locked engagement and a force-locked engagement, wherein the drive device is configured to drive the eccentric shaft via the gear member.

8. The mechanically controllable valve-train assembly as recited in claim 7, wherein the cylinder head comprises abutment faces arranged thereon, the gear member being abutted on both sides by the abutment faces in an axial direction.

9. The mechanically controllable valve-train assembly as recited in claim 7, wherein the gear member further comprises a projection portion on which the at least one cam element is formed.

10. The mechanically controllable valve-train assembly as recited in claim 9, wherein the cylinder head comprises abutment faces arranged thereon, the gear member being abutted on both sides by the abutment faces in an axial direction.

11. The mechanically controllable valve-train assembly as recited in claim 1, wherein each transmission assembly comprises at least one pivot lever and at least one tilt lever, wherein the at least one pivot lever is configured to engage one of the plurality of gas exchange valves via a work curve, and the at least one tilt lever is operatively connected to the valve-lift adjusting device and to the camshaft and is configured to engage the at least one pivot lever via a work contour.

* * * * *